US005910083A

United States Patent [19]

Richardson et al.

[11] Patent Number: 5,910,083

[45] **Date of Patent: *Jun. 8, 1999**

[54] INTEGRAL SPACER FOR DOOR RAIL

[75] Inventors: Richard James Richardson, Simi Valley; Charles E. Crown, San Fernando, both of Calif.

[73] Assignee: New Anthony, Inc., San Fernando, Calif.

[ * ] Notice: This patent is subject to a terminal disclaimer.

[21] Appl. No.: 08/695,924

[22] Filed: Aug. 12, 1996

Related U.S. Application Data

[63] Continuation-in-part of application No. 08/237,558, May 3, 1994, Pat. No. 5,544,454, which is a continuation of application No. 07/849,900, Mar. 12, 1992, Pat. No. 5,363,611, which is a continuation-in-part of application No. 07/644,072, Jan. 18, 1991, Pat. No. 5,113,628, which is a continuation-in-part of application No. 07/585,602, Sep. 20, 1990, Pat. No. 5,097,642.

[51] Int. Cl.[6] ..... E06B 3/00

[52] U.S. Cl. ..... 52/171.1; 52/208; 52/309.4; 52/656.1; 52/788.1; 49/504; 312/116; 312/138.1

[58] Field of Search ..... 52/213, 204.1, 52/208, 171.1, 309.4, 788.1, 656.1, 656.4, 656.9; 49/501, 504, 386, 402, DIG. 2; 312/116, 138.1

[56] References Cited

U.S. PATENT DOCUMENTS

| | | |
|---|---|---|
| 2,173,649 | 9/1939 | Firner . |
| 2,173,664 | 9/1939 | Shutts . |
| 2,282,831 | 5/1942 | Shutts . |
| 2,348,307 | 5/1944 | Richardson . |
| 2,589,064 | 3/1952 | Drake . |
| 2,708,774 | 5/1955 | Seelen . |
| 2,872,713 | 2/1959 | Haas . |
| 2,880,475 | 4/1959 | Mills . |
| 3,280,523 | 10/1966 | Stroud et al. . |
| 3,376,670 | 4/1968 | Jones . |
| 3,426,482 | 2/1969 | Mock . |
| 3,465,485 | 9/1969 | Knipper . |
| 3,520,084 | 7/1970 | Gigante . |
| 3,922,828 | 12/1975 | Patton . |
| 3,940,900 | 3/1976 | Russo . |
| 3,949,526 | 4/1976 | Sherlock et al. . |
| 4,109,432 | 8/1978 | Pilz . |
| 4,124,322 | 11/1978 | Parisien . |
| 4,205,470 | 6/1980 | Kapneck . |
| 4,223,482 | 9/1980 | Barroero . |
| 4,459,789 | 7/1984 | Ford . |
| 4,513,554 | 4/1985 | Johnson . |
| 4,513,555 | 4/1985 | Johnson . |
| 4,588,235 | 5/1986 | Barroero . |
| 4,604,840 | 8/1986 | Mondon . |
| 4,612,743 | 9/1986 | Salzer . |

(List continued on next page.)

FOREIGN PATENT DOCUMENTS

| | | |
|---|---|---|
| 2572766 | 11/1984 | France . |
| 2614049 | 10/1977 | Germany . |
| 2908541 | 9/1979 | Germany . |
| 206226 | 9/1985 | Italy . |
| 0228641 | 12/1986 | Italy . |
| 0217479 | 5/1989 | Italy . |
| 0218764 | 9/1989 | Italy . |
| RE91050 U | 7/1991 | Italy . |
| RE92009 U | 2/1992 | Italy . |
| RE92033 U | 4/1992 | Italy . |

*Primary Examiner*—Carl D. Friedman
*Assistant Examiner*—Kevin D. Wilkens
*Attorney, Agent, or Firm*—Henricks, Slavin & Holmes LLP

[57] ABSTRACT

A refrigerating door construction is disclosed which includes door rail elements form one or more spacer elements between adjacent panels so that separate, discrete spacer bars may be eliminated.

29 Claims, 5 Drawing Sheets

U.S. PATENT DOCUMENTS

| | | |
|---|---|---|
| 4,624,091 | 11/1986 | Biro . |
| 4,671,582 | 6/1987 | Stromquist . |
| 4,741,127 | 5/1988 | Bockwinkel . |
| 4,753,043 | 6/1988 | Bockwinkel . |
| 4,818,043 | 4/1989 | Borgen . |
| 4,822,649 | 4/1989 | Canaud et al. . |
| 4,831,804 | 5/1989 | Sayer . |
| 4,938,521 | 7/1990 | Kunert . |
| 4,939,879 | 7/1990 | Gold . |
| 4,986,594 | 1/1991 | Gold et al. . |
| 4,998,382 | 3/1991 | Kunert . |
| 5,024,023 | 6/1991 | Kostos et al. . |
| 5,062,248 | 11/1991 | Kunert . |
| 5,111,618 | 5/1992 | Kaspar . |
| 5,113,628 | 5/1992 | Richardson et al. . |
| 5,228,240 | 7/1993 | Barroero et al. . |
| 5,270,084 | 12/1993 | Parker . |
| 5,363,611 | 11/1994 | Richardson . |

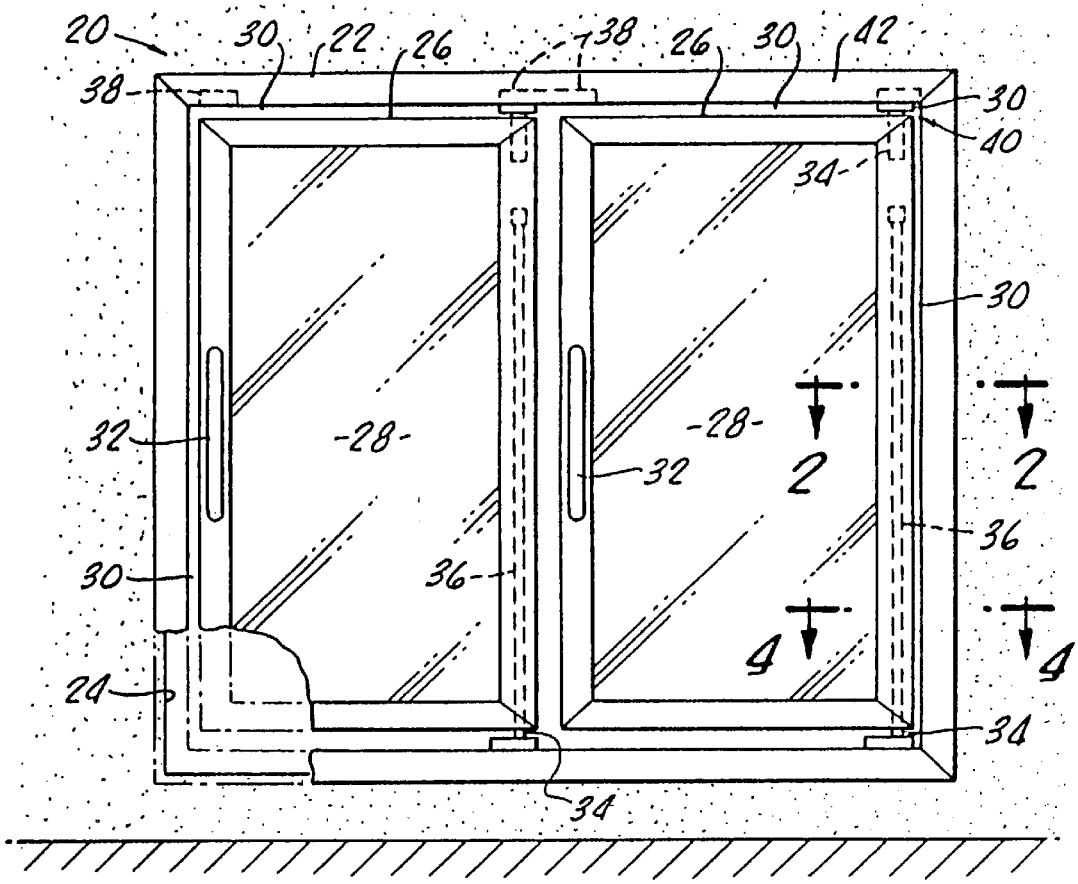
FIG. 1.
FIG. 2.
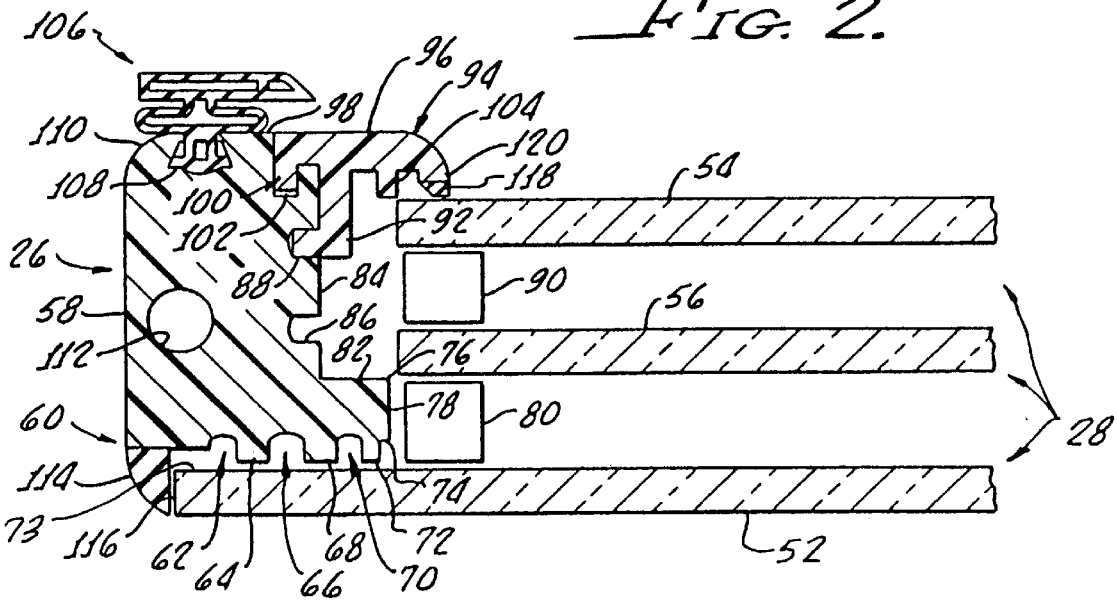

INTEGRAL SPACER FOR DOOR RAIL

CROSS-REFERENCE TO RELATED APPLICATIONS

This application is a continuation-in-part of Ser No. 08/237,558, filed May 3, 1994, now U.S. Pat. No. 5,544,454, incorporated herein by reference, which is a continuation of Ser. No. 07/849,900 filed Mar. 12, 1992, now U.S. Pat. No. 5,363,611, which is a continuation-in-part of application Ser. No. 07/644,072, filed Jan. 18, 1991, now U.S. Pat. No. 5,113,628, which is a continuation-in part of application Ser. No. 07/585,602, filed Sep. 20, 1990, now U.S. Pat. No. 5,097,642.

BACKGROUND OF THE INVENTION

1. Field Of The Invention

The present invention relates to refrigerator display case doors and more particularly to refrigerator display case doors formed from a foamed polymeric material which may allow a door having an all-glass front. This invention also relates to a refrigerator display case door whereby a portion of the rail of the door serves as a spacer between multiple glazing panels.

2. Related Art

Commercial refrigerators and refrigerator display cases are used in markets, food-vending operations, liquor stores and the like for the simultaneous preservation of freshness and attractive display of foods to the customer. Typically, commercial display cases have frames defining an opening for the case which is accessed through large, swinging doors having large areas of multi-layered glazing to permit the customer to see, select and access the refrigerated product easily, while preventing heat transfer into the refrigerated space. Typically, a metal door rail supports and surrounds the multi-layered glazing to support the glazing panels and to protect the edges thereof.

Present commercial glass refrigerator doors typically have door rails which extend peripherally around the glass panels of the doors. Such door rails are used to hold the glass panels in place and extend peripherally around both the inside and outside glass surfaces of the doors. As a result, the door rails can be seen from the outside of the doors, detracting from the appearance of the glass doors.

Door rails have heretofore been formed from extruded or other forms of metal rail elements fastened together at mitered corners of upper and lower horizontal rail members and left and right vertical side members. The hardware for connecting the corners of the rail structure quite often is complicated, using a significant number of interfitting parts to provide a suitable corner connection. Hinge elements support the door for pivotable movement relative to a vertical axis.

The metal rail members, while providing suitable structural support and pleasing aesthetic appearance, readily conduct heat from outside the refrigerated display case as well as serving as a condensation surface for water vapor which may be present in the ambient air. To eliminate condensation and fogging, heater wires are sometimes placed in the door rail to warm the metal rail and to thus inhibit condensation. To change the aesthetic appearance, some rails have been redesigned to place a substantial amount of the metal rail behind the front panel, but there still exists rail material that extends over the front glazing panel.

There is a need for a refrigerated display case door rail which is mounted entirely behind the front glazing panel, which is thermally efficient and minimizes the conduction of heat into the refrigerated display case, which minimizes the condensation and fogging of the door and door rail under conditions of humidity, which provides a strong reliable door rail and which is easy to assemble. There is also a need for a door rail which is light weight and provides a door which has a pleasing aesthetic appearance. There further is a need for a door rail having a rail portion which can also serve as a spacer or separator between adjacent panels in a multiple panel unit.

SUMMARY OF THE INVENTION

In accordance with the present invention, a refrigerator door rail is provided, which is aesthetically pleasing, whereby the rail is placed other than in front of the front glazing panel, which minimizes heat conduction, moisture condensation and which is light weight and easy to assemble. A refrigerator door according to the present invention includes door rail elements formed from a foam polymeric substance and at least one substantially transparent panel supported by the door rail. Means are provided for connecting the door rail elements and at least one hinge is provided for allowing pivotable movement of the door about an axis. A foamed polymeric door rail structure provides a light-weight sturdy rail construction which is easy to assemble, does not require complicated corner elements and which is aesthetically pleasing in appearance.

In a preferred form of the invention, the door rail is formed from extruded foamed polyvinyl chloride (PVC) held together at each corner by an internal comer piece, an internal anchor bar and an external strap. One side of the corner piece is preferably slid into a slot in the door rail to sandwich a pair of bars on the rail between the corner piece and the anchor bar. The comer hardware provides a strong and sturdy assembly which still can be substantially hidden from view. In the preferred embodiment, the proposed rail surrounds the edges of at least one of the glazing panels while a forward panel is exposed at the front of the door to provide an uncovered glass surface which extends over a substantial portion of the door area.

An improved method of assembling a door unit having a plurality of transparent panels supported, retained by and sealed in the door rails including the steps of placing the plurality of glazing panels face down to expose a rearwardly facing surface of a forward panel in the plurality of glazing panels. The door rail elements are assembled to form a substantially rigid door rail assembly. The door frame is placed against the rear facing surface of the forward glazing panel so as to leave a gap between the door rail element and the forward glazing panel and so as to surround the outer perimeters of the remaining glazing panels. A sealing compound is injected between the glazing panels and the door frame elements. A glazing strip is joined with the door frame elements to support the glazing panels from behind the glazing panels. This method of assembly provides an easy and quick process by which the door rail assembly and the glazing panel unit can be assembled together into a door assembly. Little, if any, adjustment is necessary to ensure proper alignment and assembly of the door unit.

In a further preferred form of the invention, a door rail is formed such that a portion of the door rail serves as a spacer or support between adjacent glazing panels in a multiple glazing unit. Separate spacers are thereby eliminated.

It is therefore an object of the present invention to provide a door rail construction which is strong, sturdy but light weight and which is easy to assemble.

It is another object of the present invention to provide a door rail construction which is aesthetically pleasing in appearance and which does not extend over the front of the front glazing panel.

It is a further object of the present invention to provide a door rail structure which is more thermally efficient and less heat conductive than prior structures and which minimizes any condensation or fogging on the refrigerator display case door.

It is an additional object of the present invention to provide a light weight door rail structure formed from a foamed polymer such as polyvinyl chloride.

It is yet another object of the present invention to provide a door rail structure which is easy to assemble but wherein the corner connection assemblies are substantially hidden from view.

These and other objects of the present invention will become apparent from the drawings and the following detailed description of the preferred embodiments.

BRIEF DESCRIPTION OF THE DRAWINGS

FIG. 1 is a front elevational view of a door and frame assembly showing one application of the door rail structure according to the present invention.

FIG. 2 is a transverse cross-sectional view of a vertical portion of the door rail construction taken along line 2—2 of FIG. 1 supporting three glazing panels but omitting the case rail structure.

DETAILED DESCRIPTION OF THE PREFERRED EMBODIMENTS

Figure 3:
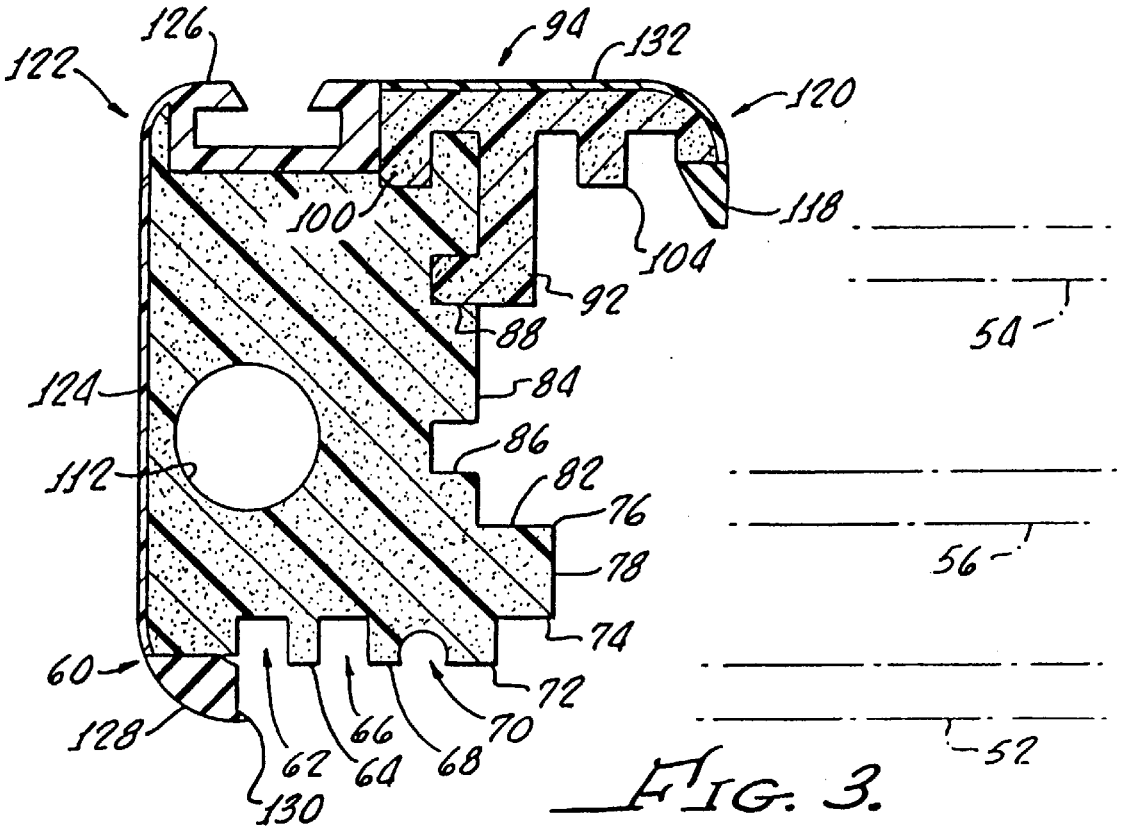
FIG. 3 is a transverse cross-section of a vertical portion of the door rail according to a preferred form of the invention similar to the view of FIG. 2.

In accordance with the present invention, a door rail assembly is shown in FIG. 1 in the environment of a refrigerated display case and providing for a strong, sturdy and light weight door rail structure which is aesthetically pleasing in appearance, easy to assemble and which minimizes condensation and fogging due to ambient humidity. The refrigerated display case 20 is typically found in markets, liquor stores, convenience stores and the like. These cases may be fabricated on a custom or semi-custom basis, in which the display unit 22 for the case is incorporated into an opening 24 of the refrigerated display case. The case is maintained at a lower temperature by conventional refrigeration equipment (not shown). The refrigerated display case 20 may contain one or more hinged doors 26, two right-hand opening doors being illustrated in FIG. 1. Each door has glazed viewing areas 28.

The doors are supported by and close over display case frame members 30, defining an opening into the refrigerated cabinet. The frame members 30 are typically fabricated from mitered extrusions, such as aluminum joined at the corners. This enables a significant amount of detail features to be incorporated into an extrusion dye, such as gasket channels, bearing apertures and the like.

The glazed doors 26 typically include handles 32 and also hinges 34 at the top and bottom corners of one vertical edge for swinging outward from the refrigerated display case. The lower hinge elements typically carry the vertical loads in the door, principally resulting from the weight of the door, and both hinges carry lateral loads applied to the door, including dynamic loads imposed on the door during opening and closing. The doors 26 may also include torque rod assemblies 36 or other biased-return mechanisms, to automatically return the doors to a closed position.

The hinge assembly includes a mounting gib and electrical connector 38 for mounting a plug-in hinge pin having a mating electrical connector for mounting in the gib at the top of a respective door to the top of the frame. Such an assembly is shown and described in U.S. Pat. No. 4,671,582. Four such mounting gibs and electrical connectors 38 are shown in FIG. 1. In FIG. 1, each door is a right-hand opening door so that the hinge assembly 40 of each door engages the right-hand mounting gib of each pair of gibs.

Figure 5:
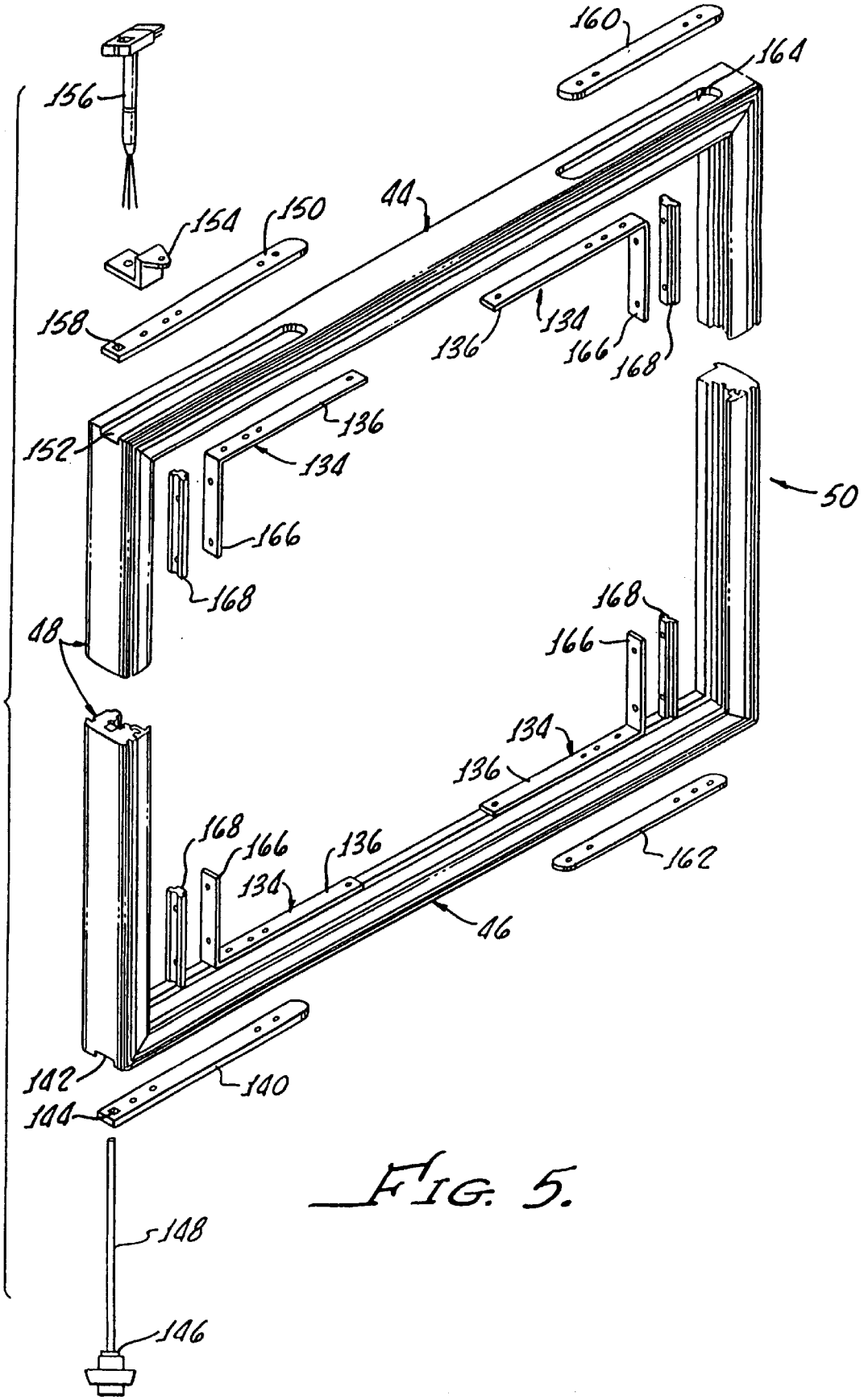
FIG. 5 is an exploded and perspective view of a part of a door rail construction according to the present invention.

Considering the refrigerator door construction in more detail with respect to FIG. 5, the refrigerator door includes a plurality of rail elements, including a top horizontal rail element 44, a bottom horizontal rail element 46, a right side element 48 and a left side element 50. The refrigerator door rail of FIG. 5 is shown from the rear of the door so that the right side element 48 is shown on the left side of the drawing. Each door rail element is preferably formed from a polymeric material such as foamed polyvinyl chloride to provide a light weight, strong and thermally efficient rail for supporting one or more glazing panels (FIG. 2). Preferably, the door rail is formed from four elements sized to accommodate the particular case frame size for the particular display case.

Door rail elements formed from a polymeric foam, such as foamed PVC, allow the rail to be designed, in transverse cross-section, so that the door has a substantially all-glass appearance from the front. An all-glass front gives an aesthetically pleasing appearance and gives the appearance of a rail-less door. The rail elements can be extended so that no part of the rail extends in front of the forward glazing panel. Preferably, no part of the rail extends forward of the rear surface of the forward glazing panel, as discussed more fully below. Rail elements according to this design give the appearance of a frame-less door and an all-glass appearance. The design also eliminates the need for special extrusion design used in conventional metal door frames to give a pleasing appearance.

In the embodiment of the door rail construction depicted in FIG. 2, the door rail 26 supports a plurality of glazing panels 28 including a forward panel 52, a rearward panel 54 and an intermediate panel 56. A substantial portion of the length of each rail element, in this embodiment of the invention, has a transverse cross-section substantially as shown in FIG. 2. The remaining cross-section of each rail element differs to accommodate various hardware elements such as corner connection units, a handle and the like. The transverse cross-sectional configuration of the rail elements accommodating such hardware is described more fully below.

The rail element has an exposed or outer facing side 58, the surface of which may be prepared in any number of ways. The outer side extends to the front or forward edge 60 of the rail element, where it extends perpendicularly inward approximately one-third of the depth of the rail element to a first sealing groove 62 for accepting a sealing compound or adhesive, such as polysulfide (not shown), for sealing between the rail element and the forward panel 52 and bonding the forward panel to the rail element. The sealant, in the preferred embodiment, seals the glazing panels 28 in the door rail and holds them in place, in conjunction with the glazing strip described more fully below. It should be understood that each of the surfaces, grooves and ridges described with respect to each rail element extends substantially longitudinally of the rail element except where accommodations are made for hardware, as would be apparent to those skilled in the art after considering the present invention. A first ridge 64 forms the inside edge of the first sealing groove and provides additional surface area for sealing and for bonding the sealant to the rail element. The first ridge 64 extends inwardly to a second sealing groove 66 which in turn is bordered by a second ridge 68 extending toward the forward panel 52 approximately the same distance as the first ridge 64. A third groove 70 may be formed rearwardly of the second ridge 68 for accepting a thermal resistive wire (not shown) for heating the rail 26 to reduce condensation and any fogging of the door unit in conditions of high humidity. It is believed that a heating wire is unnecessary with the foamed PVC rail elements in conditions below approximately 80 to 90 percent relative humidity because of the superior insulating qualities of the PVC rail element. At higher levels of relative humidity, the energy of consumption from a heating wire, if one is used, can be reduced with this door from three watts per foot to one watt per foot with the door rail construction of the preferred embodiment. The third groove is bounded on the inside by a third ridge 72 providing further surface area for contact and sealing by the polysulfide compound.

The forward glazing panel 52 and the forward portion of the door rail 26 are positioned relative to each other so as to provide a relatively small space between the ridges 64, 68 and 72 to be filled with seating compound. Sealing compound also fills the grooves and remaining space between the door rail 26 and the forward glazing panel 52 to seal and bond between the door rail and the forward glazing panel. A masking compound 73 is also placed on that portion of the forward glazing panel 52 which is adjacent the door rail and the spacer bars 80, described more fully below, to prevent viewing of the hardware behind the forward glazing panel.

The third ridge 72 defines on the inside edge thereof a relatively shallow ledge 74 terminating in a boss 76 forming a sealing surface 78 for the polysulfide compound between the sealing surface 78 and a first spacer 80 between the forward panel 52 and the intermediate panel 56. The boss 76 includes a rearwardly facing surface 82 terminating at an inside surface 84 providing a sealing surface for the outside edge of the intermediate panel 56 and the outside edge of the rearward panel 54. A fourth groove 86 is formed in the inside surface 84 for providing an additional sealing surface for the polysulfide compound approximately opposite the outward facing edge of the intermediate panel 56.

A fifth groove 88 is formed in the inside surface 84 opposite a second spacer 90 and the outside surface of the rearward panel 54 for accepting a ridge on a leg 92 of a glazing strip 94. The top of the glazing strip includes a rearwardly facing surface 96 extending at the same level rearwardly and substantially parallel to the rearwardly facing surface 98 of the rail element. The leg 92 of the glazing strip forms a bonding surface for the polysulfide compound opposite the outwardly facing side of the rearward panel 54. The surface of the leg 92 in contact with the rail element is preferably flush with the rail element. A forwardly extending arm 100 on the glazing strip extends into a receiving groove 102 formed in the rearwardly facing surface 98 of the rail element. The arm 100 and the ridge of the leg 92 extending into the fifth groove 88 retain the glazing strip 94 on the rail element so that the glazing strip can form the rearward support and retainer element for the rearward panel 54 and to provide a sealing and bonding surface for the sealing compound in the area of the rearward panel 54. The glazing strip 94 and the grooves 88 and 102 are dimensioned so that the glazing strip locks into the rail by first placing the arm 100 partly into the receiving groove 102 and then pushing and seating the glazing strip against the rail as the ridge on the leg 92 seats in the fifth groove 88. The rearwardly facing surface 96 is then preferably flush with the rearwardly facing surface 98 of the rail element. When the glazing strip is locked in place after the sealant has been placed inside the rail elements and around the glazing panels, the glazing strip is held in place until the sealant sets by clamps (not shown). A fourth ridge 104 on the inside of the glazing strip facing forwardly provides additional sealing surface on the glazing strip. A gasket 106 is retained in a gasket groove 108 to absorb the closing force of the door as the door closes. The gasket may also include a magnetic closure for drawing the door fully closed. The large contact surface of the gasket preferably extends over the joint between the glazing strip and the rail element so that the rail assembly has a one-piece, unitary appearance. This gives the door more of a rail-less appearance.

The rear or rearward facing surface 98 of the rail element meets the outer side 58 of the rail element along a curved corner portion 110. A shaft or torque pocket 112 may be formed longitudinally along an inner portion of the rail element to accept a torque rod (referenced below) for automatically closing the refrigerator door. The torque pocket is preferably formed over the full length of each rail element. In one embodiment (FIGS. 2 and 3), the torque pocket is round while in another embodiment (FIG. 4), the torque pocket is angled and then covered by a plug (substantially of the shape of element 172). The plug is routered out at the corner areas of the rail element to accommodate the connection hardware.

A soft edge protector strip 114 is co-extruded on the forwardly facing surface of the rail element beginning at the forward edge 60 of the rail element behind the front panel for protecting the forward edge 60 and the outwardly facing surface 116 of the forward panel. In the preferred embodiment, the edge protector strip 114 is formed so as to be softer than the rail element. The protector strip may, for example, have a Shore A value of 50 to 60. The edge protector strip is not load bearing and does not structurally support the glazing panels, since the strip serves to protect the rail edge and the panel edge. The edge protector strip 114 covers up any blemishes in the outwardly facing side of the forward glass panel so that the panel edge need not be fully finished. The edge protector strip also absorbs impacts and keeps dirt and particles away from the interior of the glazing panel unit.

A dual durometer tip 118 is formed from a preferably soft polymeric material similar to the edge protector strip 114 for contacting the rearward facing surface of the rearward panel 54 and forming the first seal between the rail element and the rearward panel 54. The tip 118 is preferably co-extruded on an arm 120 of the glazing strip 94. The tip 118 keeps dirt and particles away from the interior of the glazing panel unit.

Before the glazing strip 94 is locked in place, sealing compound is also added to the space between the tip 118 and the boss 78 to fill the space shown in FIG. 2. As a result, sealing compound fills the void between the edge protector strip 114 and the tip 118 to seal the rail assembly and to bond the rail assembly with the glazing panels. Sealing compound is also placed between each spacer bar 80 and 90 and the respective glazing panels in the conventional manner.

In a preferred embodiment of the rail element 122 (FIG. 3), where comparable elements are identified with the same reference numerals as were used in the embodiment of FIG. 2, the rail element preferably includes a hardened skin 124 co-extruded with the rail element, preferably from relatively harder PVC. The skin preferably extends around the exposed surface of the rail element. A gasket groove 126 is formed in the rearward facing surface of the rail element with a hardened, preferably PVC, co-extrusion for accepting the foot of a gasket (not shown). An edge protector strip 128 formed from a softer material than the rail element includes a pointed ridge 130 for bearing against the outwardly facing surface of the forward panel (shown in phantom).

The glazing strip also preferably includes a hardened skin 132 (FIG. 3) on the rearwardly facing surface which is exposed to view and contact. The hardened skin is preferably formed from a co-extruded PVC.

Each of the individual glazing panels are shown in phantom in FIG. 3. The rearward panel 54, when the door is fully assembled, bears against the tip 118 to depress the tip to approximately the same level as the lower edge of the ridge 104. Each glazing unit extends outwardly toward the rail, or in the case of the forward glazing panel 52 into contact with the edge protector strip 128, substantially to a relative position similar to the extent of the glazing panels shown in FIG. 2. Spacer bars are also included between adjacent glazing panels for the embodiment of FIG. 3 in the conventional manner.

The foam rail construction of the door provides a light weight, strong and sturdy refrigerator door rail structure which also provides good insulating qualities. The foam rail structure also absorbs stresses and supports the multiple glazing panels in conjunction with the sealant to provide a door structure having improved insulating characteristics and support features for the glazing panels. The foam rail is lighter than metal rail structures.

The rail elements are connected and held together at preferably mitered corners by corner connecting units (FIG. 5). Each connecting unit provides a strong and sturdy connection assembly whose elements are substantially hidden from ordinary view. The connections are strong and easy to assemble. Each corner connecting unit includes an internal corner piece 134 having a horizontal side 136 resting in a corner piece groove 138 (FIG. 4) routered in the inside surface of the rail element. A groove is routered in the inside surface of the rail element so as to provide the same amount of space for sealant compound upon assembly of the door rail unit. The horizontal leg 136 of the bottom, right corner piece serves as a base for threading bolts through corresponding holes in an external strap 140 placed in a groove 142 to hold the lower, horizontal rail element 46 at the right side. The external strap 140 includes a rectangular or other angled opening 144 for accepting a correspondingly configured base 146 of a torque rod 148 for automatically closing the door after the door is released from an open position. The horizonal leg 136 of the upper, right corner piece also serves as a base for threading bolts through corresponding openings in a top external strap 150. The top external strap 150 is placed in a groove 152 formed in the right, top surface of the upper horizontal rail element 44. The right, top external strap 150 holds a retainer hold open bracket 154 mounted to the external strap. The top external strap 150 also accepts a hinge pin plug 156 through an opening 158 at the right end of the external strap for allowing pivotable movement of the door about the hinge pin plug. The hinge pin plug is passed through the opening 158 in the external strap and through corresponding openings in the right, top side of the upper horizontal rail element and a vertical shaft formed in the right side element 48. The external straps 140 and 150 permit suitable mounting of the door as an outside mount door or as a recessed door.

Upper and lower external straps 160 and 162, respectively, are used to hold the left side of the upper and lower rail elements 44 and 46, respectively, by threading bolts through openings in the external straps into corresponding openings in the horizontal legs 136 of the upper and lower left corner brackets 134. The upper external strap 160 fits in a groove 164. The upper and lower external straps do not need to extend to the left edges of the upper and lower horizontal rail elements. The external straps are placed in respective grooves to provide a strong connection assembly and to keep the external straps from normal view.

Figure 4:
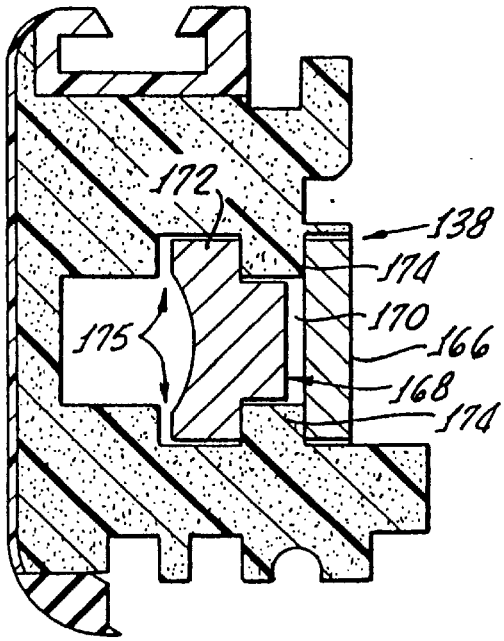
FIG. 4 is a partial transverse cross-sectional view of a vertical door rail element taken along line 4—4 of FIG. 1 showing a portion of the corner connection assembly while omitting the case rail structure.
Figure 6:
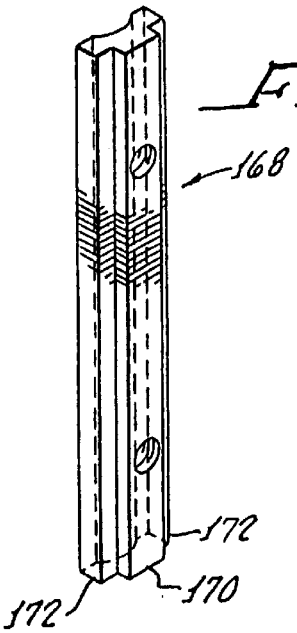
FIG. 6 is an upper perspective view of a T-slot strap used to form one part of the corner connection assembly.

Each of the corner pieces 134 includes vertical legs 166 for holding respective portions of the vertical side rail elements 48 and 50 by sandwiching internal anchor bars in the form of T-slot straps 168 (FIGS. 4, 5 and 6). Each T-slot strap includes a pedestal 170 and a wider base portion 172 to sandwich mating ledges 174 of the rail element. Each side of the base portion extending on each side of the pedestal 170 extends into grooves 174 formed in the rail element below the inside surface 84. The vertical leg 166 of the corner piece fits in a groove 138 formed in the inside surface of the rail element.

Providing hidden T-slot straps allows for an aesthetically pleasing outward appearance for the foam rail door while still providing a strong and sturdy corner piece connection and, thereby, a strong and sturdy door rail structure. The grooves in the surfaces of the rail elements are easily formed by routing or other similar process. The corner connection assemblies are easily fit to the individual rail elements and assembled.

The door rail unit is assembled by first placing the glazing panel unit face down so that the rearwardly facing surface of the forward panel is facing upward. The rearwardly facing surface of the forward panel is painted with a mask or coating to cover the rail unit when the door is finally assembled and placed in the refrigerated unit so that customers cannot see the rail structure. Sealing compound is also placed on the rearwardly facing panel in the area adjacent the rail member. The rail elements are assembled and the hardware forming the corner connections are assembled to form the door rail assembly. Sealant is injected into the spaces shown in the drawings between the door rail and the glazing panels to fully seal the space extending from the edge protector strip 114 to the rearward panel 54. The glazing strip 94 is then snapped into place, with any excess sealant filling the grooves around the ridge 104 in the glazing strip. The door unit is then fastened with clamps to hold the rail and the glazing strip against the glazing panel unit until the sealant has sealed or cured between the glazing panels and the door rail. The clamps are then removed, the gasket 106 inserted along with the remaining hardware, such as the torque rod, the hinge pin, a handle, as appropriate, and any other hardware which may be desired. It should be understood that the handle can be mounted in any suitable way such as through fasteners and the like. For example, a handle may be mounted by a flat plate on the handle passing into a slot formed in the front portion of the rail element parallel to the face 58 and opening out onto the front of the rail element where the edge protector strip is ordinarily placed. Screws can then be passed through the face 58 of the rail element to fasten the handle. Alteratively, a retaining strip may be mounted in a groove formed along the groove 86, such as by routing, and suitable fasteners passed from the outside face 58 of the rail element through corresponding holes in the plate of the handle and into threaded retainer openings in the strip.

The depth of the edge protector strip 114 from the front surface to the forward edge of the rail element if preferably 0.155" for a three panel door where the depth of the rail itself from the forward surface of the rail to the rearwardly facing surface 98 is 1.440". The width of the edge protector strip is preferably 0.250". The tip 130 preferably extends 0.035" sideways away from the rest of the edge protector strip. A cut is preferably formed in the edge protector strip between the strip and the door fame element to form a wedge gap extending at approximately 30 degrees outwardly from the forward facing surface of the rail element terminating at approximately 0.030" from the front face of the rail element. The radius of curvature of edge protector strip is preferably approximately 0.250". The tip 130 preferably extends outwardly in an angle of approximately 30 degrees from a plane parallel to the forward glazing panel.

The tip 118 is preferably 0.125" wide at its base where it joins the glazing strip and extends outwardly toward the rear panel straight on the right side and at an angle of 30 degrees inwardly toward the rear glazing panel from left to right to a tip 0.120" away from the glazing strip.

In one embodiment of the present invention, a foam rail element 176 (FIG. 9) includes a first rail element 178. Where the first rail element 178 is formed from a foamed polymeric material such as PVC, the first rail element preferably includes a skin 180 extending around the exposed surface of the first rail element from a gasket pocket 182 to an edge protector strip 184, those elements being formed in a manner similar to those elements described above with respect to FIGS. 3 and 4. The first rail element 178 forms a bonding surface for the forward glazing panel 186 through a sealing compound 188. The first rail element includes a spacer element 190 for separating and supporting adjacent glazing panels, namely the forward glazing panel 186 and the intermediate glazing panel 192. The intermediate glazing panel 192 is sealed at its forward side to the spacer portion 190 through sealing compound 192. A spacer block 194 supports the intermediate glazing panel 192 at the rearwardly facing surface of the intermediate glazing panel and is sealed thereto by the sealant 193. The spacer element 194 also supports the forward facing surface of the rearward glazing panel 196 and is sealed through sealant 193. The spacing element 194 is sealed and adhesively bonded to the first rail element 178 through the sealant 193 extending around the perimeter of the spacer element 194. The spacer element preferably includes a pair of ridges 198 intermitting with corresponding grooves in the first frame element. The rear glazing panel 196 is supported at its rearward facing surface by a glazing strip 200 having a tip 202 to form a seal at the rear glazing panel 196. The glazing strip is bonded to the rear glazing panel through sealant 193. The glazing strip preferably includes a skin 204 substantially the same as the skin 180 on the first rail element.

Figure 9:
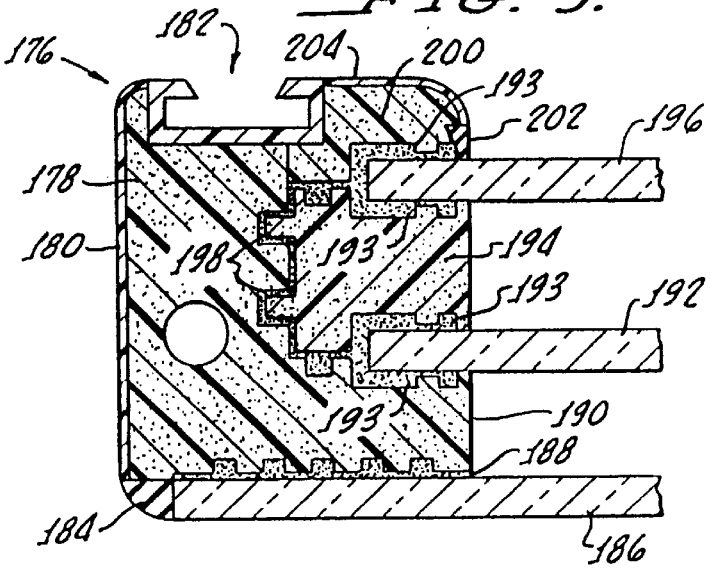
FIG. 9 is a transverse cross-section of a vertical portion of a door rail construction according to another embodiment of the present invention showing portions of a rail element separating and supporting adjacent glazing panels.
Figure 8:
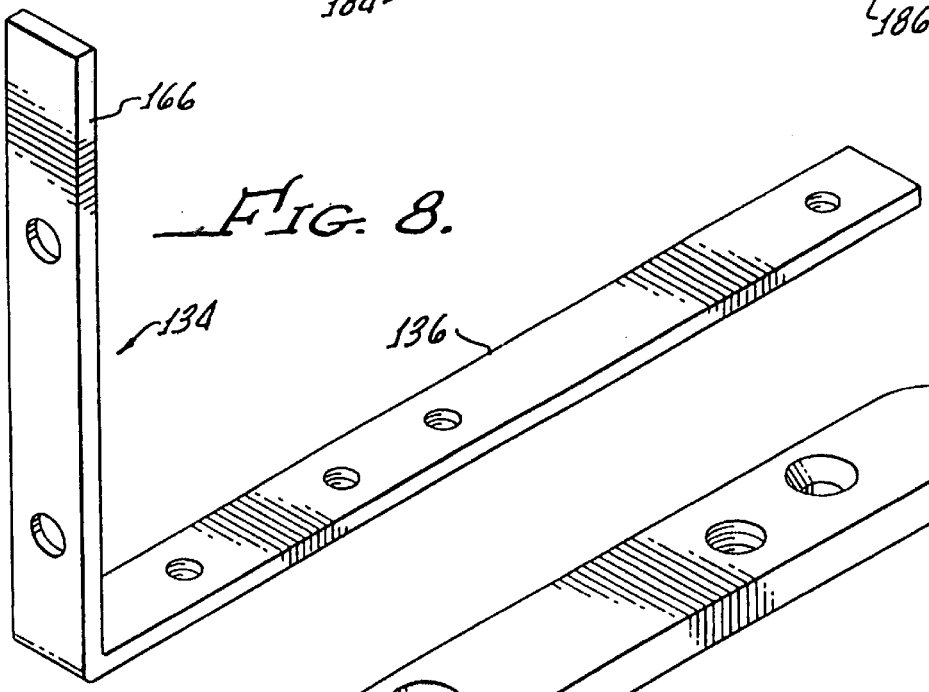
FIG. 8 is a perspective view of a comer piece for use in forming the corner connection assembly.
Figure 7:
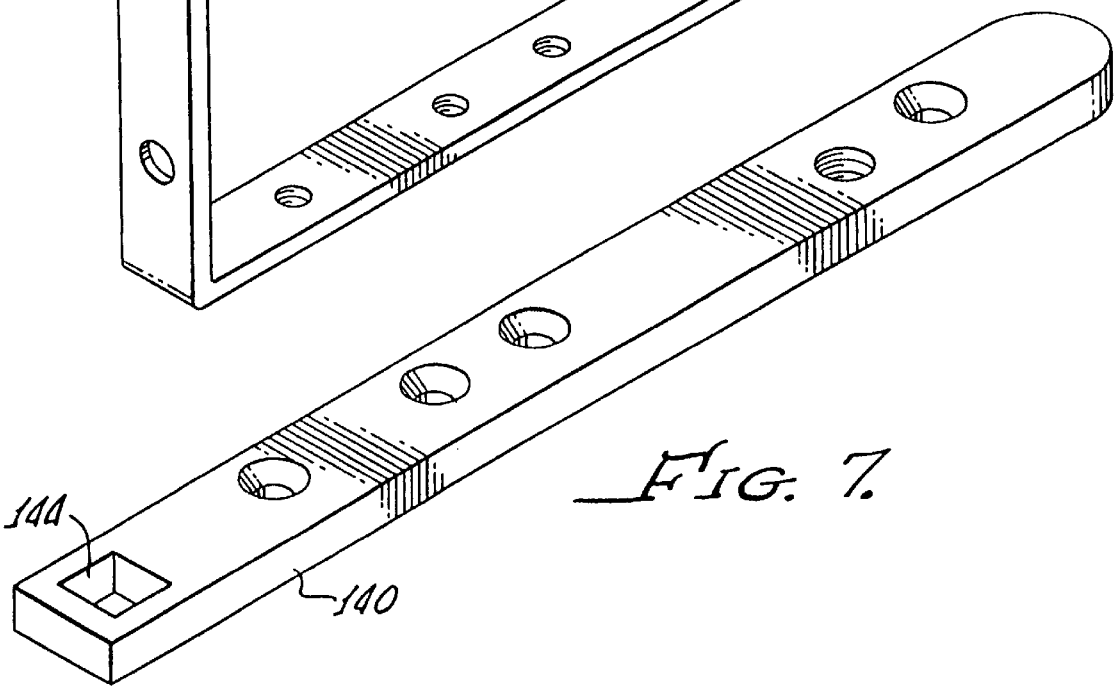
FIG. 7 is a perspective view of a torque rod/hinge pin strap used as part of the corner connection assembly.

Assembly of the door construction shown in FIG. 9 is accomplished by placing a suitable mask and then sealing compound on the rearward facing surface of the forward glazing panel 186 and placing the mating surface of the first rail element against the sealing compound. The sealing compound is then placed on the spacer element 190 and the intermediate glazing panel placed on the sealing compound. Additional sealing compound is added along with the intermediate spacer element 194 followed by the rearward glazing panel 196 and an appropriate amount of sealing compound. The glazing strip 200 is then placed over the rearward glazing panel 196 and in engagement with the gasket pocket 182 and the first rail element 178 to form the final door assembly. Clamps are placed about the assembly until the sealing compound is cured. Suitable connecting hardware may be used to connect the horizontal and vertical rail elements to provide a sturdy and reliable door assembly having a pleasing outward appearance and a substantially all-glass front. In this embodiment, the door rail structure provides a thermally efficient construction and a lightweight rail assembly resulting in an improved door construction.

Figure 10:
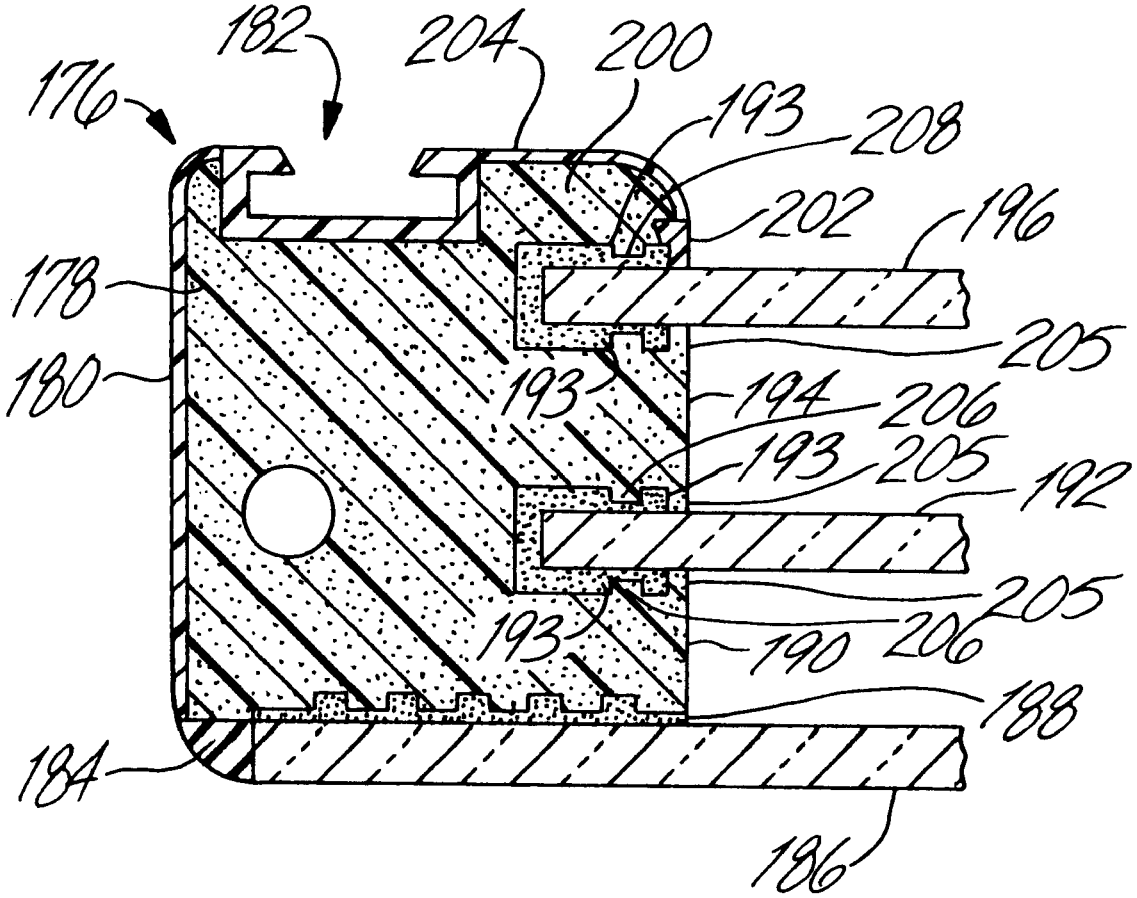
FIG. 10 is a transverse cross-section of a vertical portion of a door rail construction according to another embodiment of the present invention showing portions of a rail element separating and supporting adjacent glazing panels.

The benefits of a combined rail and spacer combination can also be achieved by making the spacer element substantially integral with the corresponding rail, as shown in FIG. 10. The elements of FIG. 10 which are common to FIG. 9 are identically numbered. In this embodiment, the rails for the top, bottom, and sides are formed in a substantially identical manner as to the spacer and rail portions (but not as to the comer connection configurations between adjacent rails). The glass unit is assembled during the same operation as the rail assembly, and sealed using sealant 193. Sealant 193 is injected into the pockets defined by first outer projections 205 on the spacer elements and inner projections 206 on the spacer elements. The rear-most pocket for the rear-most panel 196 is also defined by an outer projection on the tip 202 and an inner projection 208. The pockets will be receiving the edges of the panels 192 and 196, and the rails are placed around the panel edges. The forward panel 186 can be but need not be installed after the intermediate and rearward panes are in place. Pressure may be applied, for example by clamps, as necessary to ensure proper sealing between the rail/spacer and the sealant, and between the sealant and the panels.

In the preferred embodiment for FIG. 10, the air between the panels is substantially replaced with an inert gas, as is well known, to avoid the need for a dessicant. This can be accomplished by boring through a small part of a rail to access the space between the panels and replacing the air with an inert gas. The bore is then sealed. This embodiment permits a low cost and easy to assemble unit which is thermally efficient.

It is to be understood that the embodiments of the invention disclosed herein are illustrative of the principles of the invention and that other modifications may be employed which are still within the scope of the invention. Accordingly, the present invention is not limited to those embodiments precisely shown and described in the specification but only by the following claims.

We claim:

1. A refrigerator door comprising:

a plurality of panels including a forward panel and at least one rearwardly disposed panel;

a door rail element for supporting the plurality of panels such that substantially no part of the rail of at least one door rail element overlaps the forward panel wherein the door rail element includes at least one spacer element extending from the door rail element into a space between adjacent panels of the plurality of panels and wherein the spacer element is part of the door rail element; and at least one hinge at least partly internal to the door rail element for allowing pivotal movement of the door about an axis.

2. The door of claim 1 wherein the spacer element is bonded to the adjacent glazing panels by a sealing compound.

3. The door of claim 1 wherein the spacer element includes a non-uniform surface for engaging a complimentary surface on the door rail element.

4. The door of claim 3 wherein the non-uniform surface on the spacer includes a projection and wherein the door rail includes mating recesses for accepting the projections to form an engagement between the door rail and the spacer element.

5. The door of claim 4 wherein the spacer element includes at least two projections and wherein the door rail includes at least two recesses.

6. The door of claim 4 wherein the spacer element includes recesses for accepting sealant.

7. The door of claim 1 wherein the spacer element is integral with the rail element.

8. The door of claim 7 wherein the rail includes a first projection and the spacer element includes a second projection extending toward the first projection defining a distance between them for defining a recess for sealant wider than the distance between the projections and wherein the glass panel has an edge extending into the recess.

9. The door of claim 8 wherein the rail and spacer element includes further projections for accepting sealant for bonding to the panels.

10. A refrigerator door comprising:

a first, second and third panels;

a door rail element for supporting the panels such that substantially no part of the door rail of at least one door rail element overlaps the forward panel wherein the door rail element includes at least one spacer element extending from the door rail element into a space between adjacent panels of the plurality of panels and wherein the spacer element is part of the door rail element, wherein the spacer element includes a spacer projection and a spacer recess and the rail includes a rail projection extending toward the spacer recess and a rail recess wherein the spacer projection extends toward the rail recess on the spacer element for defining a recess for accepting sealant;

sealant on the rail element and in the recess defined by the spacer element and the rail and wherein the sealant contacts and is bonded to the first, second and third panels, and wherein the first panel has first and second oppositely facing surfaces and is contacted only on one surface by the sealant; and at least one hinge at least partly internal to the door rail element for allowing pivotal movement of the door about an axis.

11. The door of claim 10 wherein the door rail is formed from a hardened polymeric material.

12. The door of claim 11 wherein the material is a foamed PVC material.

13. The door of claim 10 wherein the spacer and the rail are formed from the same material.

14. The door of claim 13 wherein the spacer and the rail are formed from a foamed PVC material.

15. The door of claim 10 wherein the one of the rail and the spacer includes at least one projection and the other of the spacer and rail includes a recess for accepting the projection.

16. The door of claim 15 wherein the rail includes a projection which defines one side of two recesses in the rail separated by the projection for receiving projections on the spacer.

17. The door of claim 10 wherein the rail further defines an integral spacer for separating two adjacent panels.

18. A refrigerator door comprising:

a plurality of panels including a forward panel and at least one rearwardly disposed panel;

a hardened polymeric door rail element for supporting the plurality of panels such that substantially no part of the door rail of at least one door rail element overlaps the forward panel, wherein the door rail element includes a front portion and a rear portion wherein the door rail element is relatively inflexible between the front portion and the rear portion, wherein the door rail element includes at least one spacer element extending from the door rail element into a space between adjacent panels of the plurality of panels and wherein the spacer element is part of the door rail element; and at least one hinge at least partly internal to the door rail element for allowing pivotal movement of the door about an axis.

19. The door of claim 18 wherein the spacer is integral with the rail.

20. The door of claim 18 wherein the spacer is bonded to the rail.

21. The door of claim 18 wherein the door includes two spacers and one spacer is integral with the rail and wherein one spacer is bonded to the rail.

22. The door of claim 18 wherein the door includes two spacers and both spacers are integral with the rail.

23. The door of claim 18 wherein the door rail has a material characteristic and further includes a skin layer having a material characteristic different than the material characteristic of the material in the rail underneath the skin layer.

24. The door of claim 18 wherein the door has two spacers and each spacer has grooves for accepting sealant.

25. The door of claim 24 wherein the rear glazing strip includes projections for engaging the rail.

26. The door of claim 25 wherein the glazing strip includes a soft tip for engaging a rearward panel.

27. The door of claim 18 further comprising a rear glazing strip formed from a polymeric material.

28. The door of claim 27 wherein the glazing strip is integral with the rail.

29. A refrigerator door comprising:

a plurality of panels including a forward panel and at least one rearwardly disposed panel;

a door rail element for supporting the plurality of panels such that substantially no part of the door rail of at least one door rail element overlaps the forward panel, wherein the door rail element includes a front portion and a rear portion wherein the door rail element is relatively inflexible between the front portion and the rear portion, wherein the door rail element includes at least one spacer element extending from the door rail element into a space between adjacent panels of the plurality of panels and wherein the spacer element is part of the door rail element; and at least one hinge at least partly internal to the door rail element for allowing pivotal movement of the door about an axis.

* * * * *